US005554064A

United States Patent [19]

Breivogel et al.

[11] Patent Number: 5,554,064

[45] Date of Patent: Sep. 10, 1996

[54] ORBITAL MOTION CHEMICAL-MECHANICAL POLISHING APPARATUS AND METHOD OF FABRICATION

[75] Inventors: Joseph R. Breivogel, Aloha; Samuel F. Louke, Beaverton; Michael R. Oliver, Tigard; Leopoldo D. Yau; Christopher E. Barns, both of Portland, all of Oreg.

[73] Assignee: Intel Corporation, Santa Clara, Calif.

[21] Appl. No.: 103,412

[22] Filed: Aug. 6, 1993

[51] Int. Cl.[6] ..... B24B 29/00; B24B 7/22

[52] U.S. Cl. ..... 451/41; 451/60; 451/446; 451/505

[58] Field of Search ..... 451/41, 60, 446, 451/166, 173, 162, 270, 287, 288, 289, 505, 53

[56] References Cited

U.S. PATENT DOCUMENTS

| | | | |
|---|---|---|---|
| 4,831,784 | 5/1989 | Takahashi | 451/285 |
| 5,185,966 | 2/1993 | Mock, Jr. | 451/41 |
| 5,216,843 | 6/1993 | Breivogel et al. | 451/446 |
| 5,230,184 | 7/1993 | Bukhman | 451/41 |
| 5,232,875 | 8/1993 | Tuttle et al. | 437/225 |
| 5,351,445 | 10/1994 | Takahashi | 451/271 |

FOREIGN PATENT DOCUMENTS

| | | | |
|---|---|---|---|
| 0100321 | 4/1990 | Japan | 451/446 |
| 0878533 | 11/1981 | U.S.S.R. | 451/288 |
| 1027017 | 7/1983 | U.S.S.R. | 451/288 |

*Primary Examiner*—Robert A. Rose

*Attorney, Agent, or Firm*—Blakely, Sokoloff, Taylor & Zafman

[57] ABSTRACT

A method and apparatus for polishing a thin film formed on a semiconductor substrate. A table covered with a polishing pad is orbited about an axis. Slurry is fed through a plurality of spaced-apart holes formed through the polishing pad to uniformly distribute slurry across the pad surface during polishing. A substrate is pressed face down against the orbiting pad's surface and rotated to facilitate, along with the slurry, the polishing of the thin film formed on the substrate.

46 Claims, 9 Drawing Sheets

ORBITAL MOTION CHEMICAL-MECHANICAL POLISHING APPARATUS AND METHOD OF FABRICATION

BACKGROUND OF THE INVENTION

1. Field of the Invention

The present invention relates to the field of semiconductor manufacturing, and more specifically to the field of chemical-mechanical polishing methods and apparatuses for the planarization and removal of thin films used in semiconductor manufacturing.

2. Description of Relevant Art

Integrated circuits manufactured today are made up of literally millions of active devices such as transistors and capacitors formed in a semiconductor substrate. Integrated circuits rely upon an elaborate system of metalization in order to connect the active devices into functional circuits. A typical multilevel interconnect 100 is shown in FIG. 1. Active devices such as MOS transistors 107 are formed in and on a silicon substrate or well 102. An interlayer dielectric (ILD) 104, such as $SiO_2$, is formed over silicon substrate 102. ILD 104 is used to electrically isolate a first level of metalization which is typically aluminum from the active devices formed in substrate 102. Metalized contacts 106 electrically couple active devices formed in substrate 102 to the interconnections 108 of the first level of metalization. In a similar manner metal vias 112 electrically couple interconnections 114 of a second level of metalization to interconnections 108 of the first level of metalization. Contacts and vias 106 and 112 typically comprise a metal 116 such as tungsten (W) surrounded by a barrier metal 118 such as titanium-nitride (TiN). Additional ILD/contact and metalization layers can be stacked one upon the other to achieve the desired interconnection.

A considerable amount of effort in the manufacturing of modern complex, high density multilevel interconnections is devoted to the planarization of the individual layers of the interconnect structure. Nonplanar surfaces create poor optical resolution of subsequent photolithographic processing steps. Poor optical resolution prohibits the printing of high density lines. Another problem with nonplanar surface topography is the step coverage of subsequent metalization layers. If a step height is too large there is a serious danger that open circuits will be created. Planar interconnect surface layers are a must in the fabrication of modern high density integrated circuits.

To ensure planar topography, various planarization techniques have been developed. One approach, known as chemical-mechanical polishing, employs polishing to remove protruding steps formed along the upper surface of ILDs. Chemical-mechanical polishing is also used to "etch back" conformally deposited metal layers to form planar plugs or vias. In a typical chemical-mechanical polishing method, as shown in FIGS. 2*a* and 2*b*, a silicon substrate or wafer 202 is placed face down on a rotating table 204 covered with a flat pad 206 which has been coated 208 with an active slurry. A carrier 210 is used to apply a downward force $F_1$ against the backside of substrate 202. The downward force $F_1$ and the rotational movement of pad 206 together with the slurry facilitate the abrasive polishing or planar removal of the upper surface of the thin film. Carder 210 is also typically rotated to enhance polishing uniformity.

There are several disadvantages associated with present techniques of chemical-mechanical polishing. One significant problem is the different pad environments seen by different radii of the wafer being polished. This problem is due to the rotational movement of pad 206. As is apparent in FIG. 2*b*, the radius of pad 206 is significantly larger than the radius of wafer 202. During polishing, polishing pad 206 becomes worn, and a polishing track 210 develops in polishing pad 206. Inner track 210*b* of polishing pad 206 wears out faster that outer track 210*a* of polishing pad 206 because there is less pad material along inner track 210*b* than outer track 210*a*. The uneven pad wear results in a degradation of polishing uniformity across a wafer and from wafer to wafer.

Another problem associated with present chemical-mechanical polishing techniques is the slurry delivery process. As shown in FIGS. 2*a* and 2*b*, slurry is simply dumped from a nozzle 208 onto pad 206. Slurry then rotates around on pad 206 and attempts to pass under the wafer 202 being polished. Unfortunately, however, slurry builds up on the outside of wafer 202 and creates a "squeegee effect" which results in poor slurry delivery to the center of the wafer. Such a nonuniform and random slurry delivery process creates a nonuniform polishing rate across a wafer and from wafer to wafer. It is to be appreciated that the polishing rate is proportional to the amount of slurry beneath the wafer during polishing. Another problem with present slurry delivery systems is the long time it takes for slurry to reach wafer 206, pass beneath it, and finally polish. Such a long transition time prohibits a manufacturably reliable switching from one slurry to another, as may be desired in the case of polishing back a barder metal after the polishing of a via filling metal. Additionally, some slurries degrade when exposed to air for extended periods of time. The polishing qualities of these slurries can degrade in present slurry delivery systems. Each of these characteristics makes present slurry deliver techniques manufacturably unacceptable.

Thus, what is needed is a method of polishing thin films formed on a semiconductor substrate or wafer wherein polishing pad movement and slurry delivery are more uniform across the surface of a wafer so that thin films formed on the wafer surface exhibit a more uniform polish rate across the wafer and from wafer to wafer.

SUMMARY OF THE INVENTION

A novel chemical-mechanical polishing technique with an extremely uniform polish rate is described. A polishing pad is orbited about an axis. The radius of orbit of the polishing pad is less than the radius of the wafer to be polished. Polishing slurry is fed through a plurality of uniformly spaced holes formed through the polishing pad. A plurality of preformed grooves which communicate to the holes are formed in the upper surface of the polishing pad in order to facilitate uniform slurry delivery. A wafer to be polished is placed face down and forcibly pressed against the orbiting pad surface. The center of the wafer is slightly offset from the axis of orbit of the pad to prevent a pattern from developing during polishing. The wafer is rotated about its center to help facilitate polishing and to help prevent patterning.

A goal of the present invention is to provide a method for chemically-mechanically polishing thin films formed on a silicon wafer wherein the polishing environment is uniform across the surface of the wafer.

Another goal of the present invention is to provide a polishing pad which has the same movement for different radii of a wafer.

Still another goal of the present invention is to uniformly and to timely distribute slurry to the polishing pad/wafer interface during polishing.

DETAILED DESCRIPTION OF THE PRESENT INVENTION

An improved polishing apparatus and method utilized in the polishing of thin films formed on a semiconductor substrate is described. In the following description numerous specific details are set forth, such as specific equipment and materials etc., in order to provide a thorough understanding of the present invention. It will be obvious, however, to one skilled in the art that the present invention may be practiced without these specific details. In other instances, well-known machines and process steps have not been described in particular detail in order to avoid unnecessarily obscuring the present invention.

Figure 1:
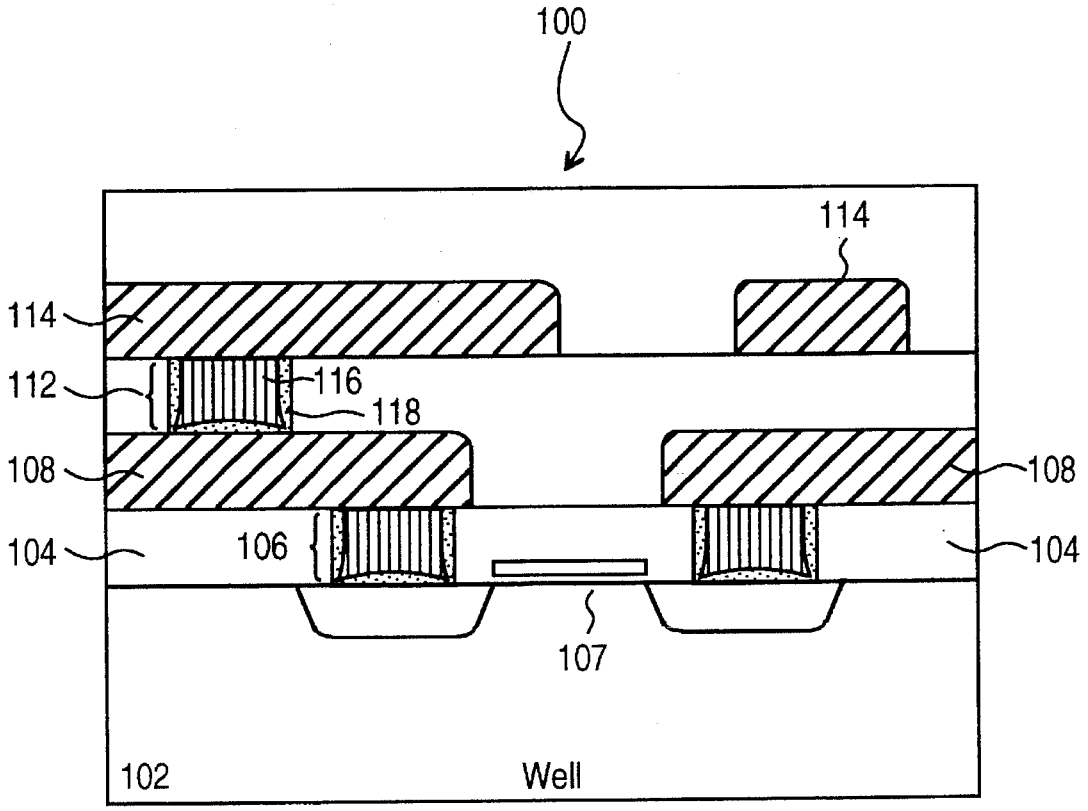
FIG. 1 is a cross-sectional illustration of a standard multilayer interconnect structure used in semiconductor integrated circuits.
Figure 2A:
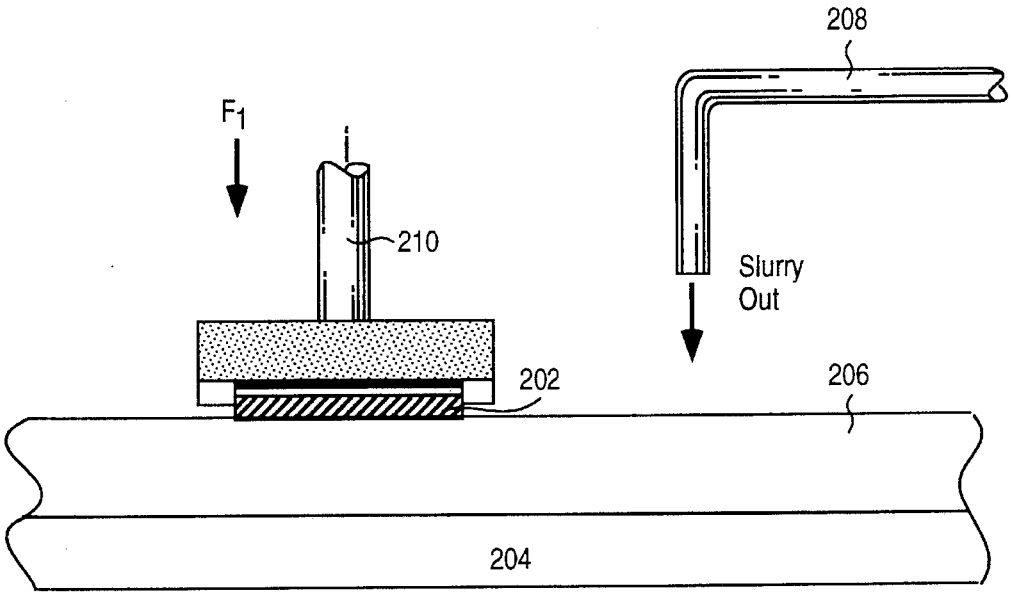
FIG. 2*a* is a cross-sectional view of an illustration of an earlier chemical-mechanical polishing technique.
Figure 2B:
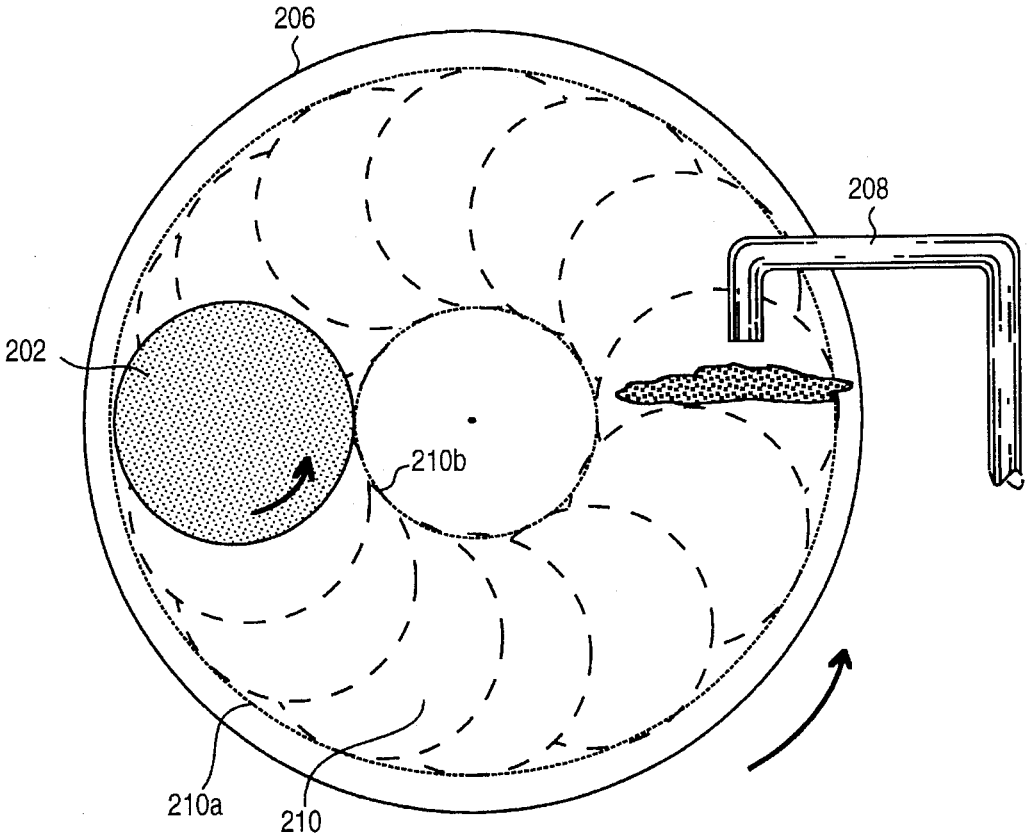
FIG. 2*b* is an overhead view of an illustration of an earlier chemical-mechanical polishing technique.
Figure 3A:
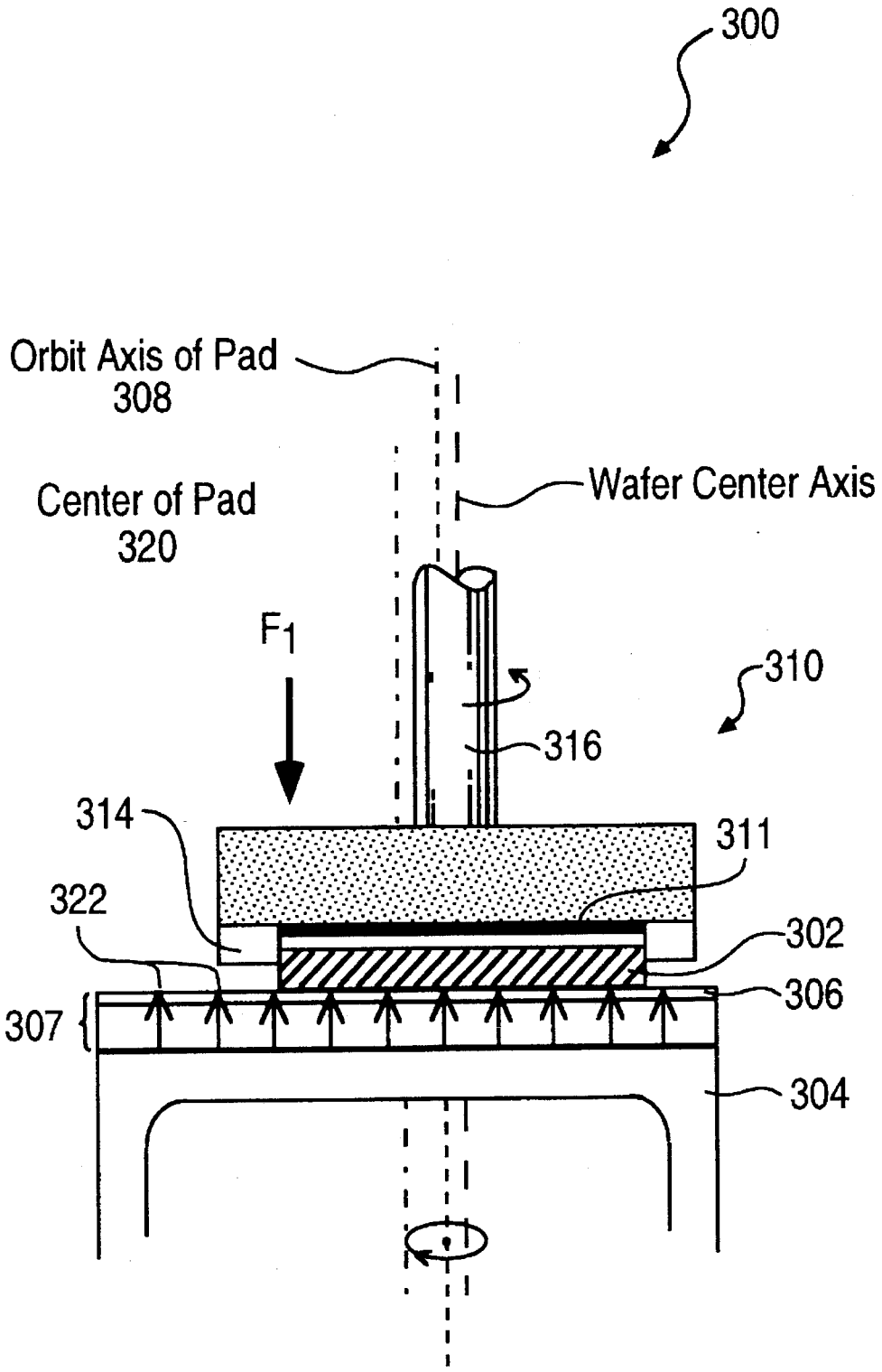
FIG. 3*a* is a cross-sectional view of an illustration of the chemical-mechanical polishing apparatus of the present invention.
Figure 3B:
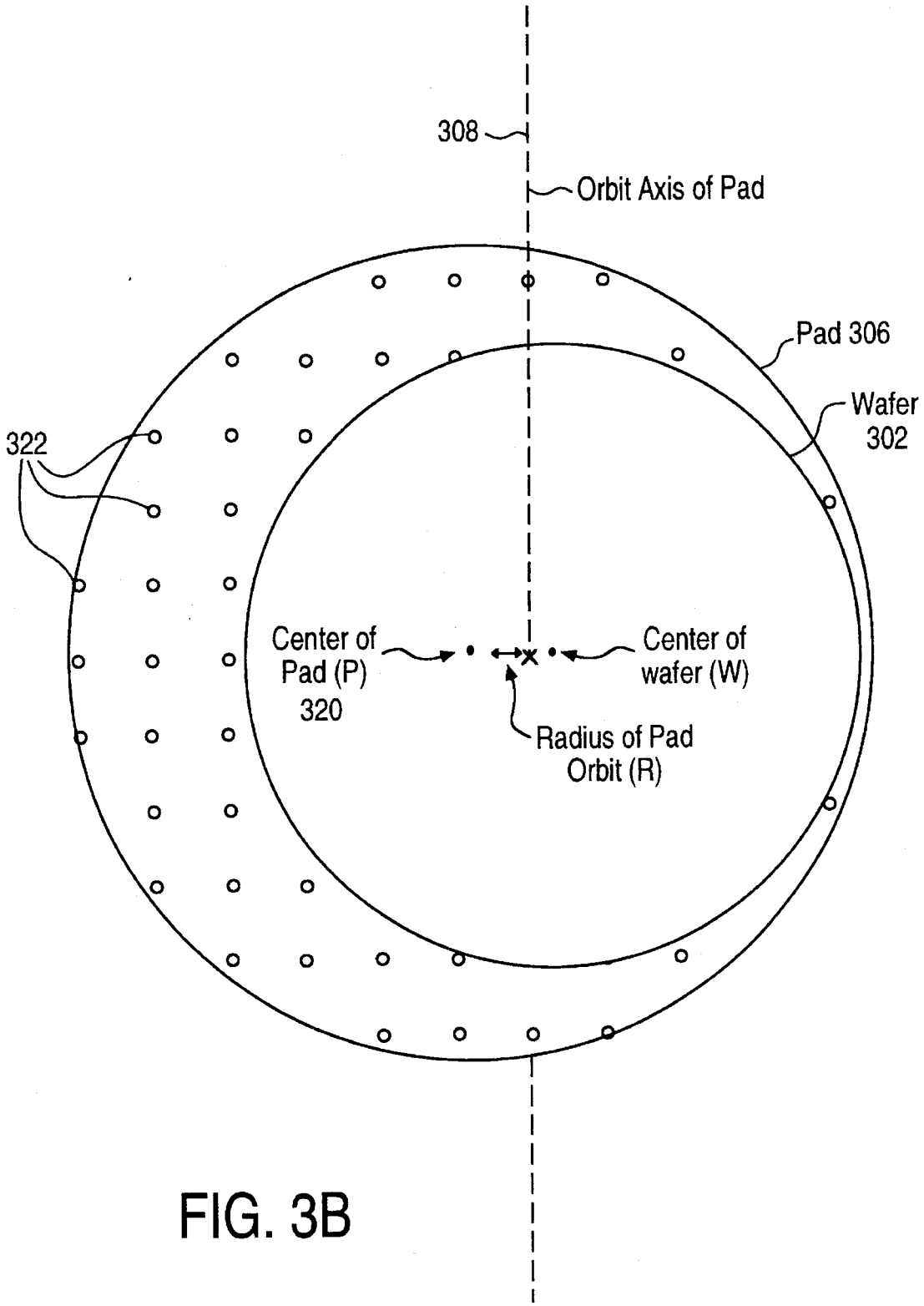
FIG. 3*b* is an overhead view of an illustration of the chemical-mechanical polishing apparatus of the present invention.

FIGS. 3*a* and 3*b* represent a cross-sectional and overhead illustration, respectively, of the polishing apparatus 300 of the present invention. The polishing apparatus 300 is used to planarize a thin film layer formed over a semiconductor substrate. In a typical use, the thin film is an interlayer dielectric (ILD) formed over and between two metal layers of a semiconductor device. In another use, the thin film is a metal such as tungsten which has been conformally deposited onto an ILD and into via openings, and which is then polished back to form planar plugs or vias. The thin film, however, need not necessarily be an ILD or a metal for a plug, but can be any one of a number of thin films used in semiconductor integrated circuit manufacturing such as, but not limited to, metal layers, organic layers, and even the semiconductor material itself. In fact, the chemical-mechanical polishing technique of the present invention can be generally applied to any polishing process which uses similar equipment and where nonuniform slurry delivery or pad movement across a wafer causes a nonuniform polish rate. For example, the present invention may be useful in the manufacture of metal blocks, plastics, and glass plates etc.

In accordance with the present invention a semiconductor substrate or wafer 302 is placed face down on a pad 306 of pad assembly 307 which is fixedly attached to the upper surface of a table 304. In this manner the thin film to be polished is placed in direct contact with the upper surface of pad 306. In the present invention, the center 320 of table 304 and pad 306 orbits clockwise about a fixed point 308. The radius (R) of the orbit is less than the radius of the wafer to be polished. In the present invention polish pad 306 is only slightly larger than wafer 302. The center 31 8 of wafer 302 is offset from the center 320 of pad 306 and from the axis of orbit 308. Slurry is delivered to the wafer/pad interface by feeding slurry through a plurality of equally spaced holes 322 formed throughout polish pad 306. The polishing process is facilitated by uniformly distributing slurry at the wafer/pad interface while pad 306 orbits about a fixed point 308 and wafer 302 rotates counter clockwise about its center (W) with a downward force. Polishing is continued in this manner until the desired planarity or film removal has been achieved.

A carrier 310 can be used to apply a downward pressure $F_1$ to the backside of wafer 302. The backside of wafer 302 can be held in contact with the bottom of carrier 310 by a vacuum or simply by wet surface tension. Preferably an insert pad 311 cushions wafer 302 from carrier 310. An ordinary retaining ring 314 can be employed to prevent wafer 302 from slipping laterally from beneath carrier 310 during processing. The pressure $F_1$ is applied by means of a shaft 316 attached to the back of carrier 310. The pressure is used to facilitate the abrasive polishing of the upper surface of the thin film. The greater the polish pressure, the greater the polish rate and wafer throughput. Planarity, however, is reduced with high polish pressures. An applied pressure $F_1$ of between 4–6 lbs/in$^2$ has been found to provide good results. Shaft 316 rotates to impart rotational movement to substrate 302. Shaft 316 can be rotated by the use of well-known means such as a belt and a variable speed motor. It is to be appreciated that other carriers can also be utilized in the present invention.

Pad 306 can be made up of a variety of materials. For example, in the planarization of an oxide based interlayer dielectric, the pad comprises a relatively hard polyurethane or similar material. In the polishing of a metal, such as tungsten, in the etchback step of a plug formation process, the pad can be a urethane impregnated felt pad. Pad 306 can be grooved to facilitate slurry delivery. Additionally, a wide variety of well-known slurries can be used for polishing. The actual composition of the slurry depends upon the type of material to be polished. Slurries are generally silica-base solutions which have different additives depending upon the type of material being polished. For example, a slurry known as SC3010 which is manufactured by Cabot Incorporated, can be utilized to polish oxide based ILDs.

Figure 4A:
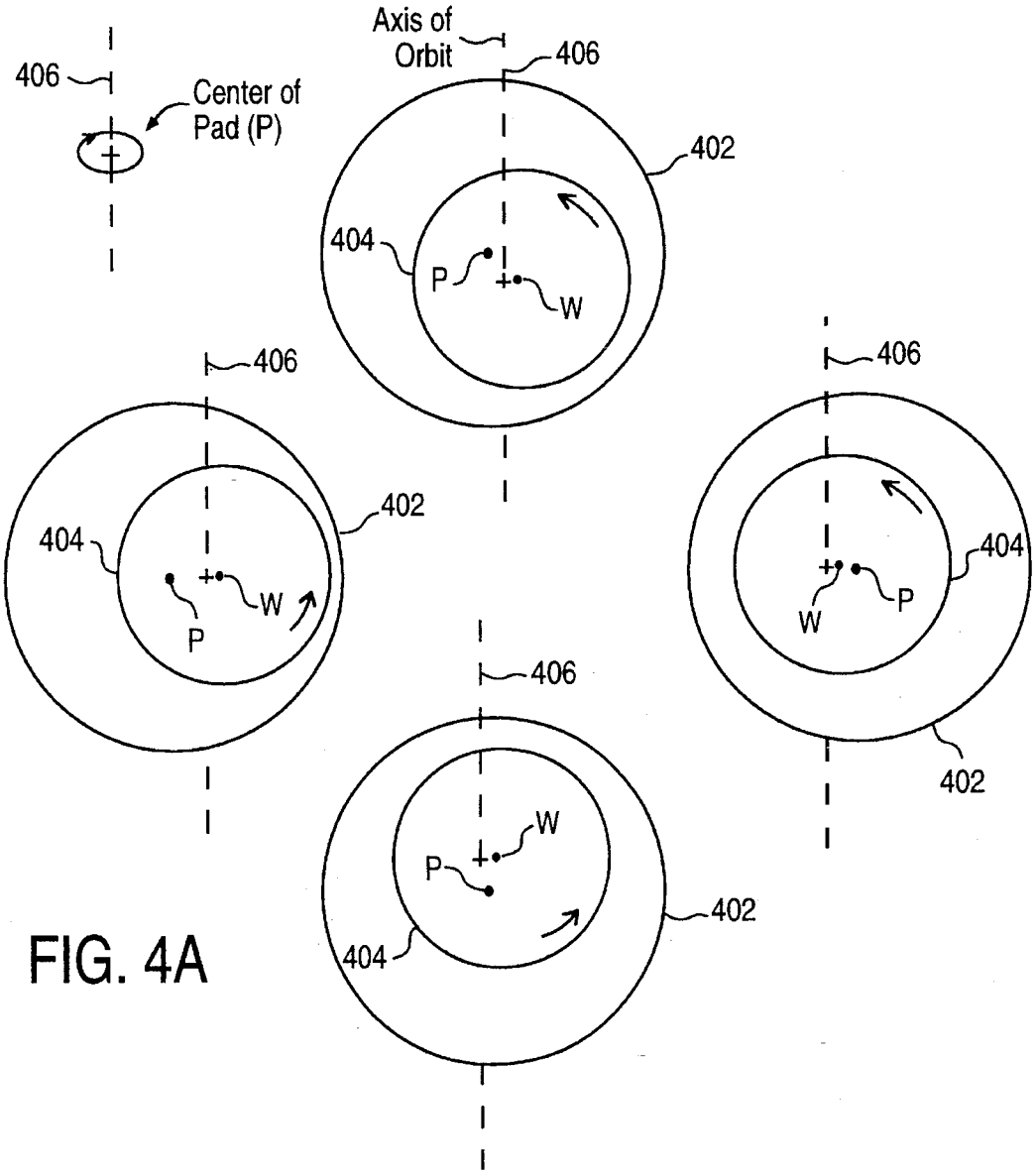
FIG. 4*a* is an overhead view illustrating the orbital movement of the pad relative to the wafer in the chemical-mechanical polishing technique of the present invention.
Figure 4B:
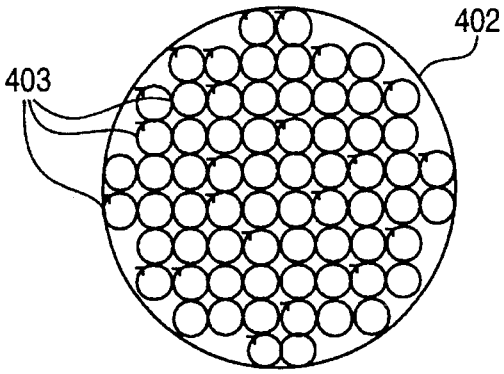
FIG. 4*b* is an illustration of the "orbital effect" of the chemical-mechanical planarization process of the present invention.

An important feature of the present invention is the fact that pad 306 orbits as opposed to rotates during polishing. The orbital movement of pad 306 with respect to wafer 302 is illustrated in FIG. 4*a*. The center (P) of pad 402 is shown orbiting under wafer 404 about an axis 406. The effect of the orbital motion of pad 404 can be generalized or illustrated as shown in FIG. 4*b*. The orbital motion of pad 402 creates a uniform movement across the surface of pad 402. Each point on pad 402 makes a complete circle 403 during each orbit of pad 402. The radius of the circle 403 is equal to the radius of the orbit of pad 402. In this way the local polishing environments seen by the surface of wafer 404 are substantially the same. In the present invention pad velocity is completely uniform across the wafer's surface. The uniform pad movement created by the orbital movement of polishing pad 402 creates a uniform polish rate across the surface of a wafer. It is to be noted, that alternatively wafer 404 can be made to orbit about a fixed axis while polishing pad 402 is rotated and still obtain the benefits of orbital polishing.

It is to be appreciated that the radius of orbit of the polishing pad should be less than the radius of the wafer being polished, and preferably substantially less. This ensures that the surface of the wafer sees substantially the same orbital motion to achieve good regional and global planarization. It will be recognized by one skilled in the art that the minimum polishing pad size is dependent upon the size of the wafer being polishing and the orbit radius of the polishing pad. It has been found that for polishing an eight inch diameter wafers, a ten inch diameter polishing pad having an approximately 0.75 inch orbit radius provides good polish uniformity. Additionally, the orbit rate of the polishing pad is chosen to optimize the balance between wafer throughput and polish uniformity. It has been found that an orbit rate of between 140–220 orbits/min provides good polish uniformity and wafer throughput.

Additionally, in the present invention, as shown in FIG. 4*a*, wafer 404 can be rotated about its center (W) by carrier 310 during polishing. The rotation of wafer 404 helps facilitate polishing and helps to smear any grooves or patterns which may develop during polishing. Rotating wafer 404 at a rate of between 5–15 rpms has been found to provide good results. Additionally, the center W of wafer 404 is offset from the axis of orbit 406 of pad 404 and the physical center (P) of pad 404. This positioning or alignment greatly enhances the smearing effect of the planarization process and helps guarantee polish uniformity.

Figure 5:
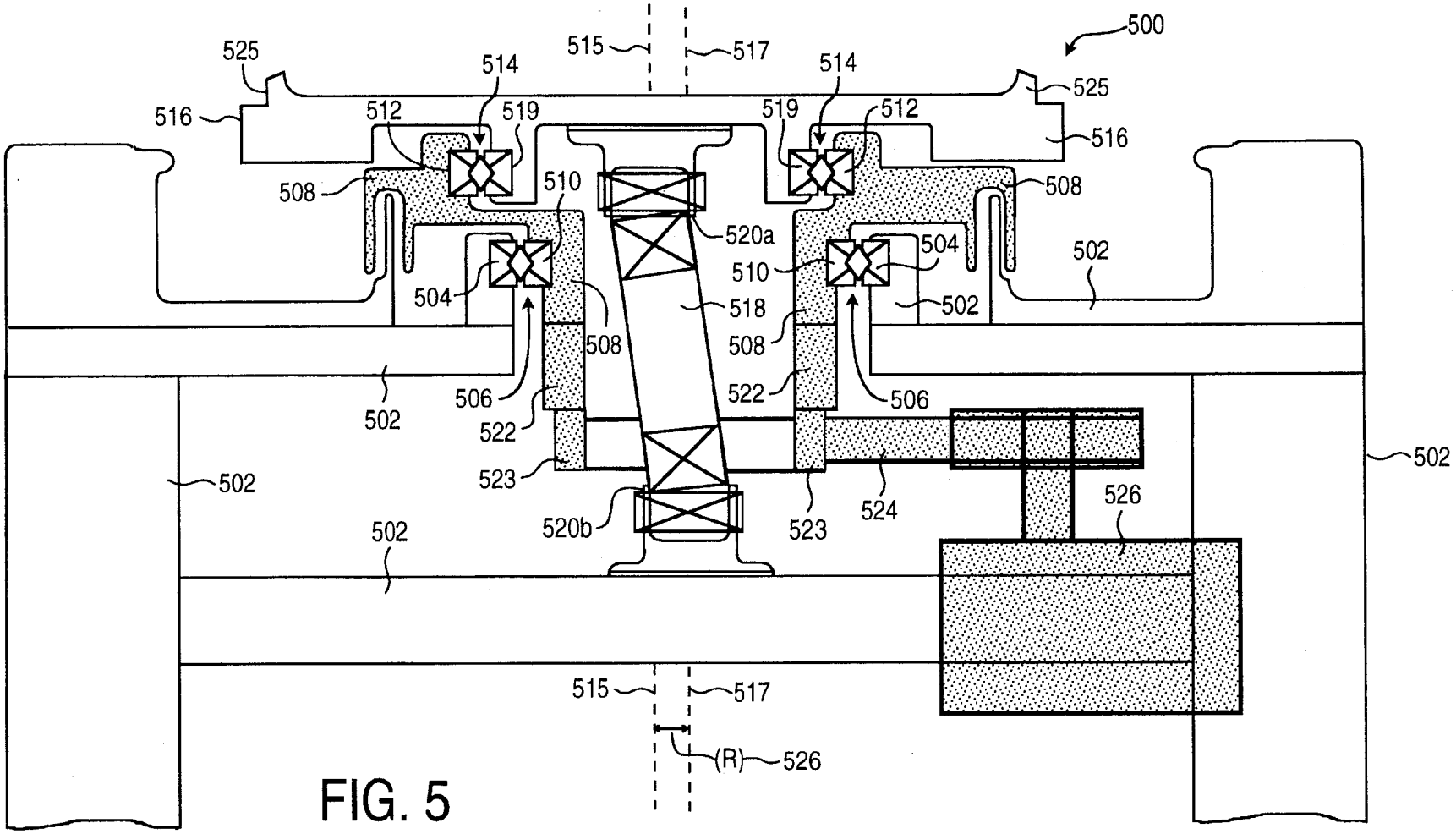
FIG. 5 is a cross-sectional view of an apparatus which can be used to generate the orbital motion for the polishing pad of the present invention.

FIG. 5 is a cross-sectional view of an apparatus which can be used to generate the orbital motion for the polishing pad. Orbital motion generator 500 has a rigid body or frame 502 which can be securely fixed to ground. Stationary frame 502 is used to support and balance motion generator 500. The outside ring 504 of a lower bearing 506 is rigidly fixed by clamps to stationary frame 502. Stationary frame 502 prevents inside ring 504 of lower bearing 506 from rotating. Wave generator 508 formed of a circular, hollow rigid stainless steel body is clamped to the inside ring 510 of lower bearing 506. Wave generator 508 is also clamped to outside ring 512 of an upper bearing 514. Wave generator 508 positions upper bearing 514 parallel to lower bearing 516. Wave generator 508 offsets the center axis 515 of upper bearing 514 from the center axis 517 of lower bearing 506. A circular aluminum table 516 is symmetrically positioned and securely fastened to the inner ring 519 of upper bearing 514. A polishing pad or pad assembly can be securely fastened to ridge 525 formed around the outside edge of the upper surface of table 516. A universal joint 518 having two pivoting points 520*a* and 520*b* is securely fastened to stationary frame 502 and to the bottom surface of table 516. The lower portion of wave generator 508 is rigidly connected to a hollow and cylindrical drive spool 522 which in turn is connected to a hollow and cylindrical drive pulley 523. Drive pulley 523 is coupled by a belt 524 to a motor 526. Motor 526 can be a variable speed, three phase, two horsepower A.C. motor.

The orbital motion of table 516 is generated by spinning wave generator 508. Wave generator 508 is rotated by variable speed motor 526. As wave generator 508 rotates, the center axis 515 of upper bearing 514 orbits about the center axis 517 of lower bearing 506. The radius of the orbit of the upper bearing 517 is equal to the offset (R) 526 between the center axis 515 of upper bearing 514 and the center axis 517 of lower bearing 506. Upper bearing 514 orbits about the center axis 517 of lower bearing 506 at a rate equal to the rotation rate of wave generator 508. It is to be noted that the outer ring 512 of upper bearing 514 not only orbits but also rotates (spins) as wave generator 508 rotates. The function of universal joint 518 is to prevent torque from rotating or spinning table 516. The dual pivot points 520*a* and 520*b* of universal joint 518 allow pad 516 to move in all directions except a rotational direction. By connecting table 516 to the inner ring 519 of upper bearing 512 and by connecting universal joint 518 to table 516 and stationary frame 502 the rotational movement of inner ring 519 and table 516 is prevented and table 516 only orbits as desired. The orbit rate of table 516 is equal to the rotation rate of wave generator 508 and the orbit radius of table 516 is equal to the offset of the center 515 of upper bearing 514 from the center 517 of lower bearing 506. It is to be appreciated that a variety of other well-known means may be employed to facilitate the orbital motion of the polishing pad in the present invention.

Another important feature of the present invention is the slurry delivery process. In the present invention, as shown in FIG. 3*a* and 3*b*, slurry is deposited onto the polishing pad surface by feeding slurry through a plurality of equally spaced apart holes 322 formed through the polishing pad. The holes are of sufficient size and spacing density to uniformly distribute slurry across the surface of the wafer being polished. Holes approximately 1/32 inch in diameter and uniformly spaced apart by approximately 1 inch have been found to provide good slurry delivery. By passing slurry through equally spaced holes in polish pad 602, slurry distribution across the surface of a wafer is uniform, which helps to create a uniform polish rate. Additionally, with such a technique slurry is delivered directly and immediately to the polish pad/wafer interface. This allows fast and controllable transitions between different slurry types and combinations of fluids. Additionally, by feeding slurry directly to the pad/wafer interface slurry is never exposed to air prior to polishing and is therefore unable to degrade before use. In the present invention slurry delivery is fast, predictable, and uniform, which helps make the present technique very manufacturable.

Figure 6A:
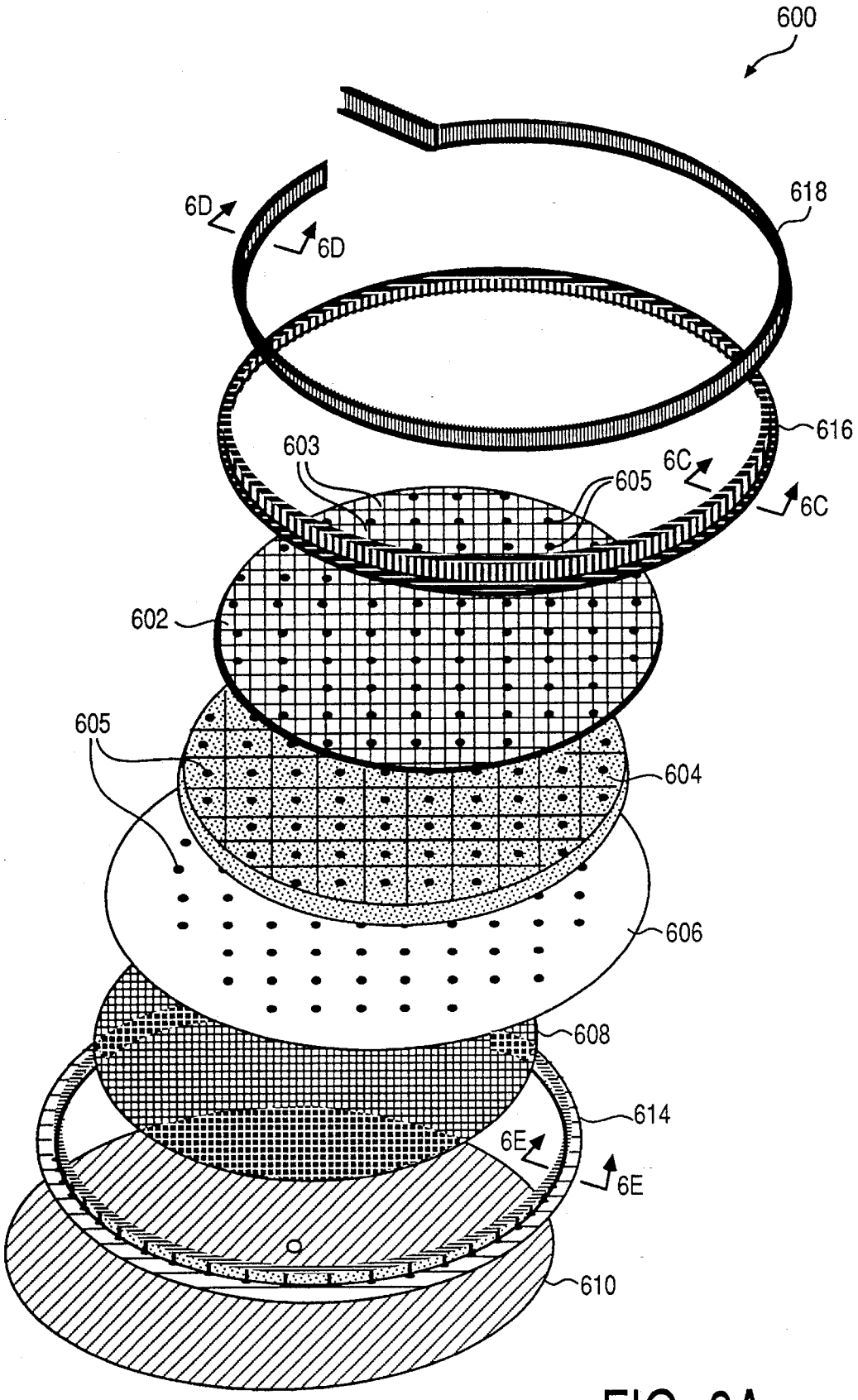
FIG. 6*a* is an exploded view of a pad assembly which can be used for attaching a polishing pad to a table and for uniformly distributing a slurry onto the pad surface during polishing.
Figure 6B:
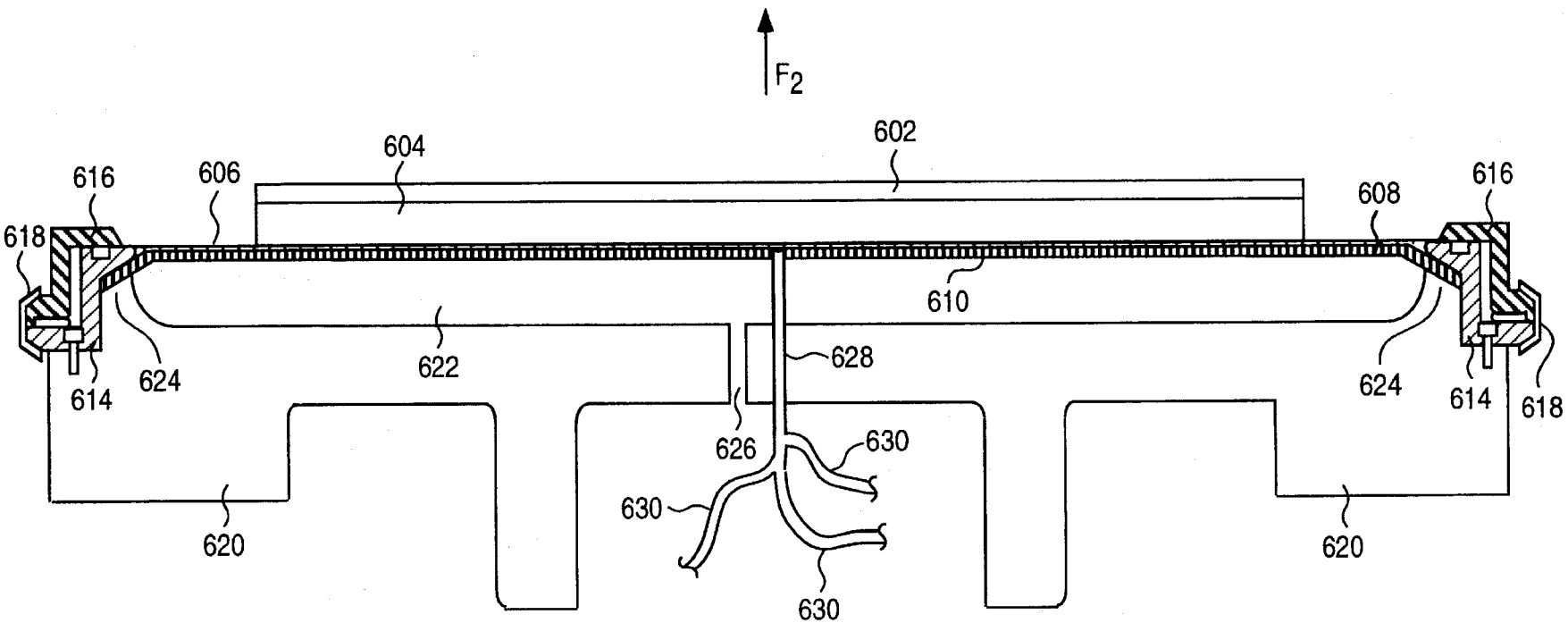
FIG. 6*b* is a cross-sectional view showing how the pad assembly of FIG. 6*a* can be attached to a table.

FIG. 6*a* is an exploded view of a pad assembly 600 which can be used to connect polishing pad 602 to an orbiting table 620 and which can be used to feed slurry through polishing pad 602. It is to be appreciated, however, that pad assembly 600 is not essential to obtain good results from orbital polishing. Other pad assemblies, such as a pad attached to a rigid table (as in the prior art), can be used and good results obtained. The use of a pad assembly similar to assembly 600, however, is strongly recommended in order to obtain the best polishing results.

As shown in FIG. 6*a*, a polishing pad 602 is securely attached to a pad backing 604. Polishing pad 602 can have a plurality of horizontal and vertical grooves 603 formed in the surface of the pad to help facilitate slurry delivery. A plurality of through holes 605 are formed through polishing pad 602. Pad backing 604 can be made up of a urethane material broken up by deep cuts to achieve a desired flexibility/stiffness for pad 602. Pad backing 604 is securely attached to a thin stainless steel polishing diaphragm 606. Through holes 605 extend through pad backing 604 and stainless steel polishing diaphragm 606 so that slurry can flow from the underside of polishing diaphragm 606 to the top surface of polishing pad 602. A rubber slurry diaphragm 610 clamped beneath polishing diaphragm 606 is used to feed slurry through slurry through holes 605. A small hole is formed through the center of slurry diaphragm 610 so that slurry can be pumped onto the top surface of slurry diaphragm 610. A plastic meshing or screen 608 is placed between stainless steel polishing diaphragm 606 and rubber slurry diaphragm 610. Meshing 608 helps to uniformly distribute or spread slurry to individual slurry through holes 605 formed in polishing diaphragm 606. A combination of a lower V clamp ring 614, an upper V clamp ring 616, and a flexible V clamp 618 can be used to attach pad assembly 600 to a table.

Figure 6C:
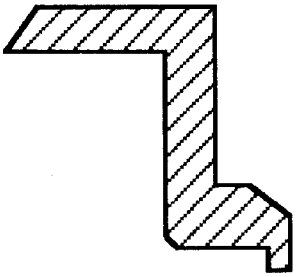
FIG. 6C is an enlarged, cross-sectional view of the flexible V clamp illustrated in FIG. 6A.
Figure 6D:
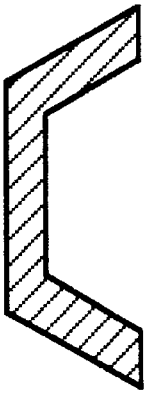
FIG. 6D is an enlarged, cross-sectional view of the upper V clamp illustrated in FIG. 6A.
Figure 6E:
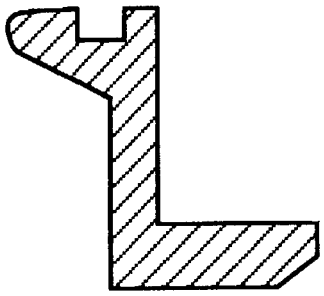
FIG. 6E is an enlarged, cross-sectional view of the lower V clamp illustrated in FIG. 6A.

An enlarged, cross-sectional view of V clamps 618, 616 and 614 are illustrated in FIGS. 6C, 6D and 6E, respectively.

FIG. **6*b* is a cross-sectional view showing how pad assembly 600 can be connected to a table 620 and slurry delivery facilitated. The outside edge of rubber slurry diaphragm 610 is clamped with a tight seal between lower V clamp ring 614 and table 620. Lower V clamp ring 614 can be securely attached by screws to table 620. Stainless steel polish diaphragm 606 (with pad backing 604 and polish pad 602 attached to its outer surface) is symmetrically placed on the top surface of lower V clamp ring 614 and then clamped into place by upper V clamp ring 616 and universal flexible V band clamp 618. The V clamp assembly allows easy pad replacement and machine maintenance. It is to be appreciated that by attaching polishing diaphragm 606 to ridge 624 formed around the perimeter of table 620 a sealed pressure chamber or housing 622 is created between table 620 and polishing diaphragm 606. Rubber slurry diaphragm 610 is retained only on its outside edge so that it can deflect up and down in pressure chamber 622. Slurry diaphragm 610 rests against table 620 in the relaxed state and deflects up against meshing 608 and polish diaphragm 606 when air pressure is injected into chamber 622**.

To deliver slurry to the top surface of pad 602 during polishing, slurry is pumped from a reservoir (not shown) onto the top surface of slurry diaphragm 610. A plurality of slurry delivery lines and Deionized water lines 630 can be routed alongside the universal joint, up through the hollow drive pulley, dry spool, and wave generator to reach orbiting table 620. The slurry delivery lines 630 are coupled to a slurry feed 628, such as a hose, provided through table 620 and through the hole in slurry diaphragm 610 so that slurry can be continually deposited onto the top surface of slurry diaphragm 610. Plastic meshing 608 is used to uniformly distribute slurry about polishing diaphragm 606 and feed slurry through slurry through holes 605 formed in polishing diaphragm 606, pad backing 604, and polishing pad 602. Plastic meshing 608 allows uniform slurry delivery by preventing slurry diaphragm 610 from directly contacting polishing diaphragm 606 when air pressure is injected into chamber 622.

Air pressure from a variable pressure source, such as a compressor, can be forced through passage 626 into chamber 622 between orbiting table 620 and the bottom surface of slurry diaphragm 610. The air pressure developed in housing 622 provides a uniform upward pressure on polishing diaphragm 606, and hence polishing pad 602. This upward pad pressure $F_2$ can be used in conjunction with, or in place of, the downward pressure normally placed on a wafer to facilitate polishing. Air pressure can be adjusted to achieve the desired upward pressure. In the present invention an upward pad pressure which is matched to the downward wafer pressure (i.e., between 4–6 lbs/in$^2$) is used to help facilitate polishing.

Novel chemical-mechanical polishing techniques have been described. The novel chemical-mechanical polishing techniques of the present invention help to create a uniform polishing environment across the surface of a wafer. A polishing pad is orbited at a radius less than the radius of the wafer to be polished in order to provide uniform pad movement across the surface of the wafer. Additionally, slurry is fed through the polishing pad to directly and uniformly provide slurry to the pad/wafer interface during polishing. It is to be appreciated that a number of different techniques have been described in the present invention which help to create a uniform and manufacturable polishing process. It is to be appreciated, however, that the techniques described in the present invention can be used independently or in combination with other techniques to improve chemical-mechanical polishing uniformity without departing from the scope of the present invention. Additionally, it is to be appreciated that one may easily change parameters such as orbit rate, orbit radius, pad sizes, polish pressure, etc., in order to optimize the polishing process for a specific application without departing from the scope of the present invention.

Thus, novel chemical-mechanical polishing techniques for creating uniform polish rates have been described.

We claim:

1. A method of polishing a thin film formed on a first surface of a substrate comprising the steps of:

forcibly pressing a polishing pad that is coupled to a flexible diaphragm together with said first surface for a period of time such that said polishing pad substantially conforms to said first surface wherein said polishing pad has an orbital motion with respect to said substrate;

depositing slurry onto said flexible polishing pad during polishing wherein said slurry is deposited onto said polishing pad by feeding said slurry through a plurality of holes formed through said polishing pad; and removing said substrate from said polishing pad after polishing.

2. The method of claim 1 wherein the radius of said orbital motion is less than the radius of said substrate.

3. The method of claim 1 further comprising the step of offsetting the center of said polishing pad from the center of said substrate during polishing.

4. The method of claim 1 further comprising the step of rotating said substrate relative to said polishing pad during polishing.

5. A chemical-mechanical polishing apparatus for polishing a thin film formed on a semiconductor substrate, said apparatus comprising:

a flexible diaphragm:

a polishing pad coupled to said flexible diaphragm, said polishing pad having a plurality of spaced apart through holes;

means for orbiting said polishing pad about an axis, wherein the radius of the orbit of said polishing pad about said axis is less then the radius of said substrate;

means for feeding an abrasive slurry through said plurality of spaced apart through holes to the surface of said polishing pad; and a substrate carrier for forcibly pressing said substrate against said polishing pad, wherein the center of said wafer is offset from said axis and wherein the orbiting movement of said polishing pad relative to said substrate together with said slurry results in a planar removal of said thin film.

6. The chemical-mechanical polishing apparatus of claim 5 wherein said polishing pad has a plurality of preformed grooves, said preformed grooves facilitating uniform distribution of said abrasive slurry.

7. An apparatus for polishing a thin film formed on a semiconductor substrate, said apparatus comprising:

a polishing pad having a plurality of spaced apart through holes;

a table having a first upper surface and a first lower surface wherein a depression is formed in the first upper surface of said table;

a flexible polishing diaphragm having a second upper surface and a second lower surface wherein said polishing pad is attached to said second upper surface, said second lower surface of said flexible polishing diaphragm being attached to the first upper surface of said table above said depression wherein said polishing diaphragm and said table form a chamber at said depression wherein pressure can be maintained in said chamber during polishing for forcibly pressing said polishing pad against said substrate:

means for providing movement to said polishing pad;

means for feeding slurry through said plurality of spaced apart through holes to the surface of said polishing pad during polishing.

8. The apparatus of claim 7 wherein said polishing pad has a plurality of preformed grooves, said preformed grooves helping to facilitate uniform distribution of said slurry.

9. The apparatus of claim 7 wherein said substrate carrier rotates said substrate against said polishing pad during polishing.

10. The apparatus of claim 7 further comprising a urethane pad backing attached between said polishing pad and said polishing diaphragm.

11. The apparatus of claim 7 further comprising:

a slurry diaphragm having an upper and a lower surface, said slurry diaphragm placed in said chamber and attached between said table and said polishing diaphragm;

a meshing placed between the upper surface of said slurry diaphragm and said polishing diaphragm, said meshing for uniformly distributing slurry about said polishing diaphragm.

12. The chemical-mechanical polishing apparatus of claim 5 wherein said substrate carrier rotates said substrate during polishing.

13. A chemical-mechanical polishing apparatus for polishing a thin film formed on a semiconductor substrate having a first diameter, said apparatus comprising:

a flexible diaphragm;

a polishing pad coupled to said flexible diaphragm, said polishing pad having a second diameter and a plurality of through holes positioned radially along said polishing pad, said second diameter being slightly larger than said first diameter;

means for orbiting said polishing pad about an axis, wherein the radius of the orbit of said polishing pad about said axis is less then the radius of said substrate;

means for feeding an abrasive slurry through said plurality of spaced apart through holes to the surface of said polishing pad; and a substrate carrier for forcibly pressing said substrate against said polishing pad wherein the orbiting movement of said polishing pad relative to said substrate together with said slurry results in a planar removal of said thin film.

14. The apparatus of claim 13 wherein said substrate is rotated relative to said polishing pad during polishing.

15. The apparatus of claim 13 wherein the center of said wafer is offset from said axis.

16. A method of polishing a thin film on a semiconductor substrate comprising the steps of:

providing a polishing pad coupled to a flexible diaphragm, said polishing pad having a diameter that is slightly larger than the diameter of said substrate;

orbiting said polishing pad about an axis wherein the radius of the orbit of said polishing pad about said axis is less than the radius of said substrate;

depositing slurry onto said polishing pad during polishing wherein said slurry is deposited onto said polishing pad by feeding said slurry through a plurality of holes formed through said polishing pad; and forcibly pressing said substrate and said polishing pad together wherein the orbiting movement of said polishing pad relative to said substrate together with said slurry results in the planarization of said thin film.

17. The method of claim 16 further comprising the step of offsetting the center of said wafer from said axis.

18. The method of claim 16 further comprising the step of offsetting the center of said polishing pad from the center of said substrate during polishing.

19. The method of claim 16 further comprising the step of rotating said substrate relative to said polishing pad during polishing.

20. An apparatus for polishing a thin film formed on a semiconductor substrate, said apparatus comprising:

a polishing pad having a plurality of spaced apart through holes;

a table having an upper surface and a lower surface wherein a depression is formed in the upper surface of said table;

a flexible polishing diaphragm attached to the upper surface of said table above said depression wherein said polishing diaphragm and said table form a chamber at said depression wherein pressure can be maintained in said chamber during polishing, said polishing pad attached above said polishing diaphragm;

a urethane pad backing attached between said polishing pad and said polishing diaphragm;

means for providing movement to said polishing pad;

means for feeding slurry through said plurality of spaced apart through holes to the surface of said polishing pad during polishing; and a substrate carrier for forcibly pressing said substrate against said polishing pad such that said movement of said polishing pad relative to said substrate together with said slurry results in a planar removal of said thin film.

21. The apparatus of claim 20 wherein said polishing pad has a plurality of preformed grooves, said preformed grooves helping to facilitate uniform distribution of said slurry.

22. The apparatus of claim 20 wherein said substrate carrier rotates said substrate against said polishing pad during polishing.

23. The apparatus of claim 20 further comprising:

a slurry diaphragm having an upper and a lower surface, said slurry diaphragm placed in said chamber and attached between said table and said polishing diaphragm;

a meshing placed between the upper surface of said slurry diaphragm and said polishing diaphragm, said meshing for uniformly distributing slurry about said polishing diaphragm.

24. An apparatus for polishing a thin film formed on a semiconductor substrate, said apparatus comprising:

a polishing pad having a plurality of spaced apart through holes;

a table having an upper surface and a lower surface wherein a depression is formed in the upper surface of said table;

a flexible polishing diaphragm attached to the upper surface of said table above said depression wherein said polishing diaphragm and said table form a chamber at said depression wherein pressure can be maintained in said chamber during polishing, said polishing pad attached above said polishing diaphragm;

a slurry diaphragm having an upper and a lower surface, said slurry diaphragm placed in said chamber and attached between said table and said polishing diaphragm;

a meshing placed between the upper surface of said slurry diaphragm and said polishing diaphragm, said meshing for uniformly distributing slurry about said polishing diaphragm;

means for providing movement to said polishing pad;

means for feeding slurry through said plurality of spaced apart through holes to the surface of said polishing pad during polishing; and a substrate carrier for forcibly pressing said substrate against said polishing pad such that said movement of said polishing pad relative to said substrate together with said slurry results in a planar removal of said thin film.

25. The apparatus of claim 24 wherein said polishing pad has a plurality of preformed grooves, said preformed grooves helping to facilitate uniform distribution of said slurry.

26. The apparatus of claim 24 wherein said substrate carrier rotates said substrate against said polishing pad during polishing.

27. The apparatus of claim 24 further comprising a urethane pad backing attached between said polishing pad and said polishing diaphragm.

28. A chemical-mechanical polishing apparatus for polishing a thin film formed on a first surface of a semiconductor substrate, said apparatus comprising:

a flexible diaphragm;

a polishing pad coupled to said flexible diaphragm, said polishing pad having a plurality of spaced apart through holes;

means for orbiting said polishing pad about an axis;

means for feeding an abrasive slurry through said plurality of spaced apart through holes to the surface of said polishing pad; and a substrate carrier for forcibly pressing said substrate against said polishing pad.

29. The chemical-mechanical polishing apparatus of claim 28 wherein the radius of said orbital motion is less than the radius of said substrate.

30. The chemical-mechanical polishing apparatus of claim 28 the center of said polishing pad is offset from the center of said substrate during polishing.

31. The chemical-mechanical polishing apparatus of claim 28 wherein said substrate carrier rotates said substrate during polishing.

32. A method of polishing a thin film formed on a first surface of a substrate comprising the steps of:

forcibly pressing a polishing pad that is coupled to a flexible diaphragm and said first surface of said substrate together for a period of time wherein said polishing pad has a motion with respect to said substrate;

depositing slurry onto said polishing pad during polishing wherein said slurry is deposited onto said polishing pad by feeding said slurry through a plurality of holes formed through said polishing pad; and removing said substrate from said polishing pad after polishing.

33. The method of claim 32 wherein said polishing pad has an orbital motion with respect to said substrate.

34. The method of claim 33 wherein the radius of said orbital motion is less than the radius of said substrate.

35. The method of claim 33 further comprising the step of offsetting the center of said polishing pad from the center of said substrate during polishing.

36. The method of claim 32 further comprising the step of rotating said substrate relative to said flexible polishing pad during polishing.

37. A chemical-mechanical polishing apparatus for polishing a thin film formed on a first surface of semiconductor substrate, said apparatus comprising:

a flexible diaphragm;

a polishing pad coupled to said flexible diaphragm, said polishing pad having a plurality of spaced apart through holes;

means for moving said polishing pad relative to said first surface of said substrate;

means for feeding an abrasive slurry through said plurality of spaced apart through holes to the surface of said polishing pad; and a substrate carrier for forcibly pressing said substrate against said polishing pad wherein the movement of said polishing pad relative to said first surface of said substrate together with said slurry results in a planar removal of said thin film.

38. The chemical-mechanical polishing apparatus of claim 37 wherein said polishing pad has a plurality of preformed grooves, said preformed grooves facilitating uniform distribution of said abrasive slurry.

39. The chemical-mechanical polishing apparatus of claim 37 wherein said polishing pad has an orbital motion with respect to said substrate.

40. The chemical-mechanical polishing apparatus of claim 39 wherein the radius of said orbital motion is less than the radius of said substrate.

41. The chemical-mechanical polishing apparatus of claim 39 wherein the center of said polishing pad is offset from the center of said substrate during polishing.

42. The chemical-mechanical polishing apparatus of claim 37 wherein said substrate carrier rotates said substrate during polishing.

43. A method of polishing a thin film on a first surface of a semiconductor substrate comprising the steps of:

providing a polishing pad that is coupled to a flexible diaphragm;

orbiting said polishing pad about an axis wherein the radius of the orbit of said polishing pad about said axis is less than the radius of said substrate;

depositing slurry onto said polishing pad during polishing wherein said slurry is deposited onto said polishing pad by feeding said slurry through a plurality of holes formed through said polishing pad; and forcibly pressing said first surface of said substrate and said polishing pad together wherein the orbiting movement of said polishing pad relative to said first surface of said substrate together with said slurry results in the planarization of said thin film.

44. The method of claim 43 further comprising the step of offsetting the center of said wafer from said axis.

45. The method of claim 43 further comprising the step of offsetting the center of said polishing pad from the center of said substrate during polishing.

46. The method of claim 43 further comprising the step of rotating said substrate relative to said polishing pad during polishing.

* * * * *

UNITED STATES PATENT AND TRADEMARK OFFICE

CERTIFICATE OF CORRECTION

PATENT NO. : 5,554,064

DATED : September 10, 1996

INVENTOR(S) : Breivogel et al.

It is certified that error appears in the above-identified patent and that said Letters Patent is hereby corrected as shown below:

In column 2 at line 30 delete "barder" and insert --barrier--

Signed and Sealed this

Fourth Day of March, 1997

*Attest:*

*Attesting Officer*

BRUCE LEHMAN

*Commissioner of Patents and Trademarks*